US005309642A

United States Patent [19]

McGinnis

[11] Patent Number: 5,309,642

[45] Date of Patent: May 10, 1994

[54] MAT MARKING AND CUTTING APPARATUS

[75] Inventor: Michael J. McGinnis, Santa Rosa, Calif.

[73] Assignee: Murray Borod, Santa Rosa, Calif.

[21] Appl. No.: 845,552

[22] Filed: Mar. 4, 1992

[51] Int. Cl.[5] ..... B26D 7/01; B43L 13/00

[52] U.S. Cl. ..... 33/32.2; 33/32.3; 33/42; 33/476; 33/455; 33/468; 33/564; 33/581; 33/614

[58] Field of Search ..... 83/455, 467.1, 468, 83/522.11, 522.19, 564, 581, 614, 745; 33/32.1, 32.2, 32.3, 42, 476; 30/293, 294

[56] References Cited

U.S. PATENT DOCUMENTS

| | | | |
|---|---|---|---|
| 491,307 | 2/1893 | Gaylord | 83/455 |
| 513,851 | 1/1894 | Wheeler | 83/614 |
| 3,527,131 | 9/1970 | Ellerin | 83/522 |
| 3,774,495 | 11/1973 | Matthew | 83/522 |
| 3,964,360 | 6/1976 | Schwartz | 83/614 X |
| 3,996,827 | 12/1976 | Logan | 83/614 X |
| 4,158,977 | 6/1979 | Logan | 83/614 X |
| 4,881,439 | 11/1989 | Biedermann et al. | 83/614 X |
| 4,949,462 | 8/1990 | Spencer | 33/42 X |
| 4,956,919 | 9/1990 | Granger | 33/32.2 |
| 4,986,156 | 1/1991 | McGinnis | 83/467 |

*Primary Examiner*—Eugenia Jones

*Attorney, Agent, or Firm*—Richard C. Litman

[57] ABSTRACT

An artwork mat marking and cutting apparatus for use in cutting mat and similar material for picture framing and the like is disclosed. The apparatus includes a combined marking and bevel cutting device and a dual scale conversion ruler for ease of measurement in laying out mat borders. The conversion ruler has a cooperating extension which fits within a grooved guide, the guide having a T square like end for squaring the mat material with the apparatus. The outer borders of the mat material may be cut using a straight cutting device in combination with the above guide. The guide includes a feature allowing the cutter to traverse the entire sheet of material. Both the bevel and straight cutting devices allow the blade to be retracted when not cutting, and have various adjustment and other features. An alternative adaptor provides for the use of the bevel cutting device to make cuts perpendicular to the mat material surface.

18 Claims, 5 Drawing Sheets

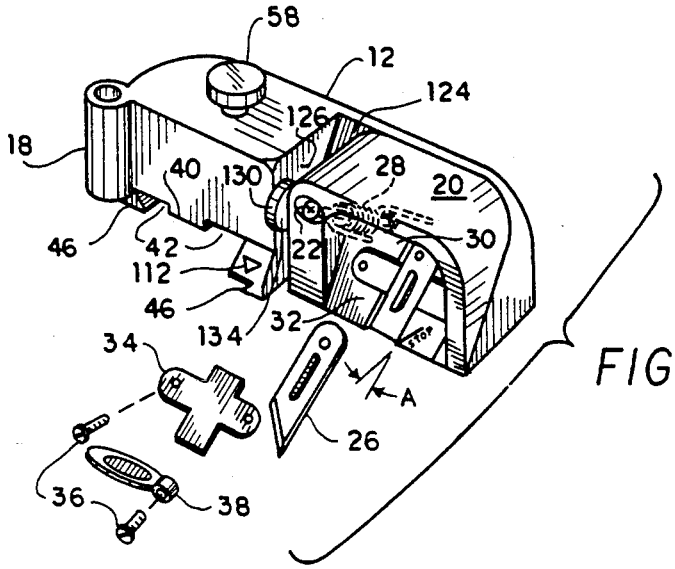
FIG. 2
FIG. 3A
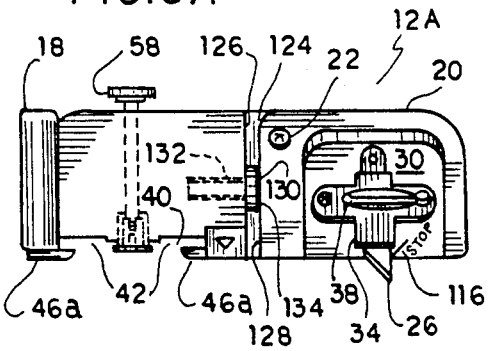
FIG. 3B
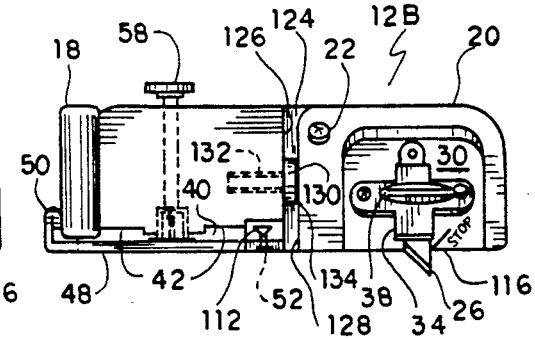
FIG. 3C
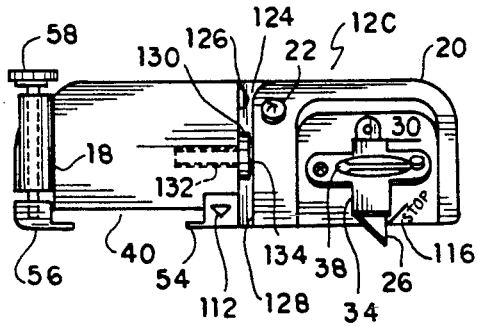
FIG. 3D
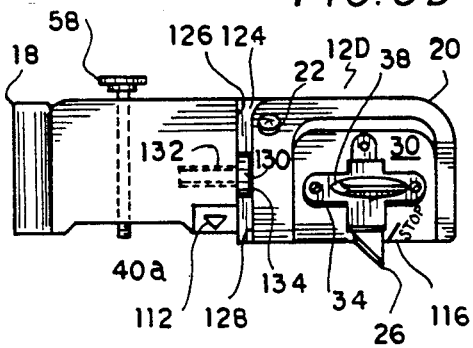

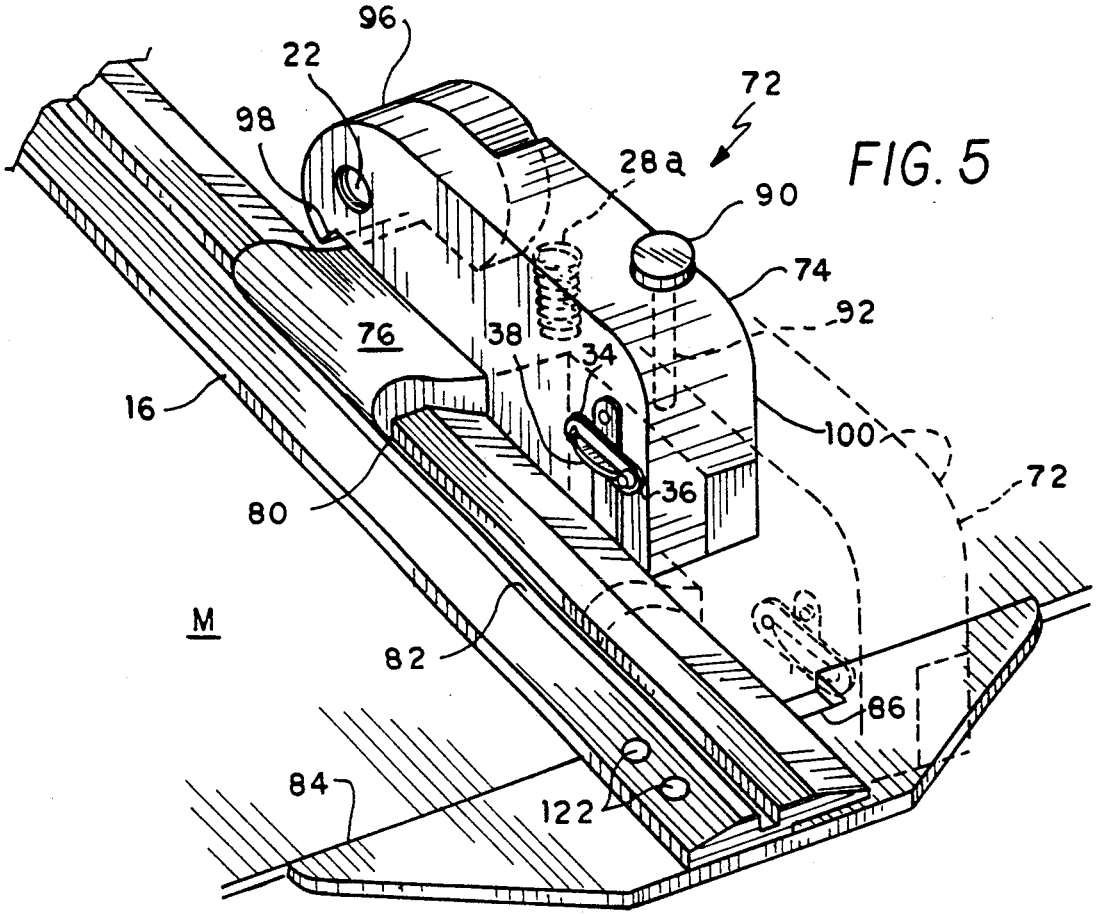
FIG. 5
FIG. 6
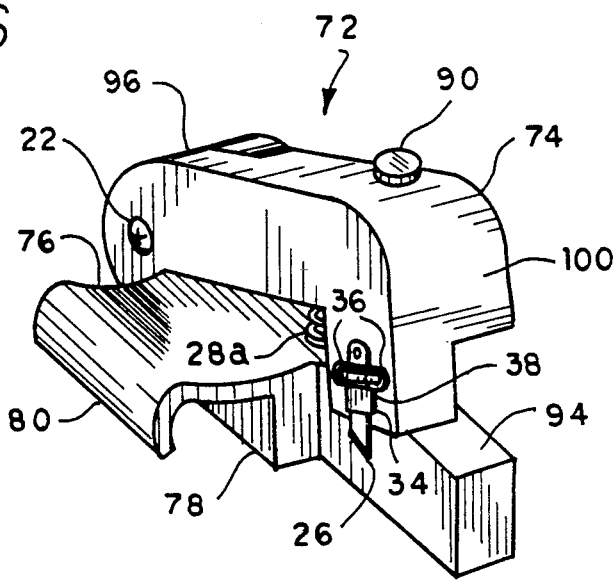

FIG. 7
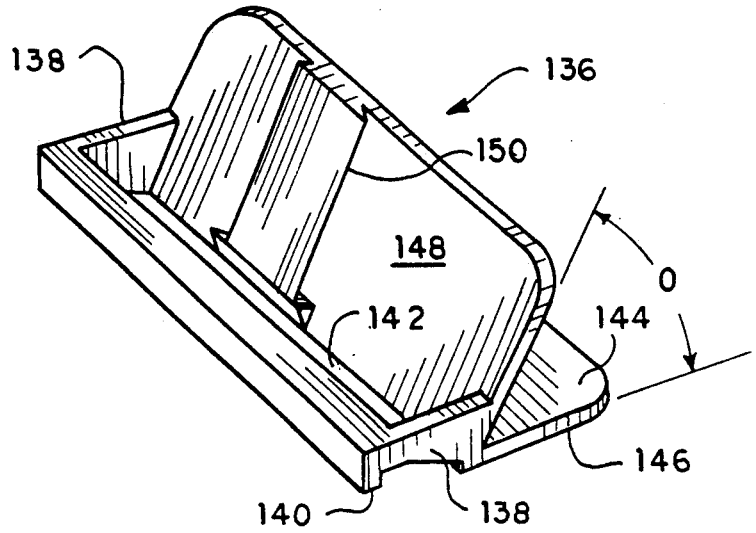
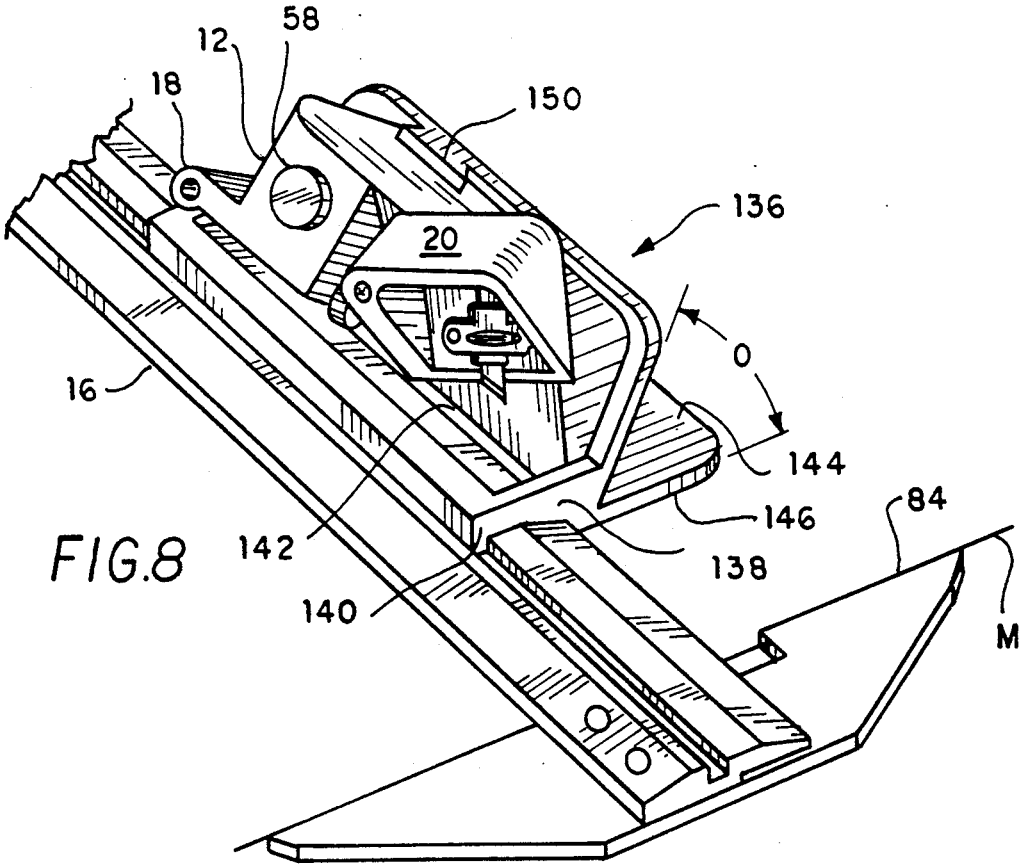
FIG. 8

MAT MARKING AND CUTTING APPARATUS

FIELD OF THE INVENTION

This invention relates generally to devices used in the cutting of mat material in picture framing and the like, and more specifically to an improved mat cutting apparatus which provides for an integral measuring scale and improved combination marking and cutting assembly, as well as other improvements.

BACKGROUND OF THE INVENTION

While a number of mat cutting and related devices are known, most require some amount of calculation in order to provide for the equal borders generally desired in such picture framing mats. While the calculations generally involved require no more than basic arithmetic, it is nevertheless extremely easy to make some small error and thus destroy a sheet of mat material by mismeasurement and cutting. While the use of a measuring rule containing two scales (half and full) removes some of the inconvenience from such mat cutting operations, the measurements must still be accomplished using a separate article of equipment which adds to the complexity of the operation to some extent.

Other mat cutting devices further require that the pencil or marker used to mark the cutting line on the mat material be operated manually along a straightedge. The cutting blade must then be aligned with the pencil mark and drawn along the line for the cut. This provides numerous possibilities for error in: (1) making the initial calculation, (2) marking the line for the cut, and (3) making the cut itself.

Another problem with other mat cutting devices is that generally the blade is applied to the mat board with relatively pressure provided with the fingers or a thumb. While mat cutting devices are known which provide retractable blades, the springs which apply the retraction pressure are generally relatively weak in order that the operator may easily override the spring pressure to make the cut. Such weak spring pressure may not cause the blade to retract when the cut is completed, due to the friction of the sides of the cut mat material on the sides of the blade.

The need arises for a mat cutting device which eliminates many of the above additional steps and calculations, but mechanically simplified over other such machines capable of performing such functions. The apparatus should combine as many of the various steps involved as possible. Moreover, the apparatus should be capable of being used over any suitable planar surface, rather than being integral with or requiring a specialized cutting or layout table or surface.

DESCRIPTION OF THE RELATED ART

Gaylord U.S. Pat. No. 491,307 discloses a picture mat cutting device which provides a cutting board integrated with the remainder of the apparatus. Two perpendicular scales are used for measurement, which measurement and marking require separate operations from the cutting operation. Marking of the material is accomplished by means of a device producing an indentation at the corner points only, rather than a pencil or other mark extending entirely along the intended cutting line. The cutting device is separate from the remainder of the apparatus and is operated by sliding along a guide. Mechanical stops are used to determine the beginning and end of each cut. This device also provides a positive clamping means to hold the material in position during the cutting operation. The patent to Gaylord does not disclose any means of simplifying the various steps involved.

Wheeler U.S. Pat. No. 513,851 discloses a mat cutting machine which contains most of the features disclosed in the patent to Gaylord discussed immediately above. The Wheeler device provides a plurality of cutting knives or blades and is relatively complex because most of the various operations must be performed separately. Again, no provision is made for combining or simplifying the various steps as in the present invention.

Ellerin U.S. Pat. No. 3,527,131 discloses a mat cutter combined with a cutting board and two perpendicular scales. This device is primarily intended for cutting beveled openings in mat material. The cutting board itself is grooved for cutting blade clearance. No means is provided for the automatic retraction of the cutting blade when not in use, as in the present invention.

Matthew U.S. Pat. No. 3,774,495 discloses a sheet material cutting device and cutting block therefor which again is in combination with a cutting board. Two perpendicular scales are provided, but unlike applicant's invention, both contain the same scale. Moreover one of the scales is provided with a raised portion to clear the other scale, which may lead to parallax errors in measurement. While a retraction spring is provided for the cutting blade or knife, the cutting assembly is intended to be operated with finger or thumb pressure which by necessity requires a relatively weak spring in order to permit the user to override the spring pressure to force the cutting blade into the mat material.

Finally, applicant's previously issued U.S. Pat. No. 4,986,156 discloses a mat cutting device which provides for two measuring scales as in the patents discussed above. However, one of those scales is one half of the other, thus providing for ease of measurement in laying out symmetrical borders in mat material with a minimum of arithmetical calculation; this feature is also used in the present invention. Further, applicant's previously issued patent does not provide for many of the advantages of the present invention as discussed in detail further below, such as the ability to combine many of the heretofore separate operations previously involved in the production of a mat picture frame or the like.

None of the above noted patents, either singly or in combination, are seen to disclose the specific arrangement of concepts disclosed by the present invention.

SUMMARY OF THE INVENTION

By the present invention, an improved apparatus for the marking and cutting of mat material for picture framing and the like is disclosed.

Accordingly, one of the objects of the present invention is to provide an improved mat marking and cutting apparatus which provides for a marking device which is integrated with a cutting unit.

Another of the objects of the present invention is to provide an improved mat marking and cutting apparatus which provides for equal borders in a mat picture frame or the like without the need for appreciable mathematical calculations by the operator.

A further object of the present invention is to provide an improved mat marking and cutting apparatus which does not require an integrated cutting surface or board, but may be used over any suitable planar surface.

An additional object of the present invention is to provide an improved mat marking and cutting apparatus which is capable of making both perpendicular and bevel cuts in mat board material and the like.

Yet another object of the present invention is to provide an improved mat marking and cutting apparatus which provides for the operation of the cutting head assemblies either toward or away from the operator, either by pushing or pulling the cutting head, thus further providing for natural operation by either left or right handed operators.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 2 is an exploded view of the bevel cutting unit of FIG. 1.

FIG. 3A is a side view of an alternative embodiment of the bevel cutting unit of FIGS. 1 and 2, showing an alternative means of securing the cutting unit to the conversion ruler.

FIG. 3B is a side view of a second alternative embodiment of the bevel cutting unit of FIGS. 1 and 2, showing a further alternative securing means.

FIG. 3C is a side view of a third alternative embodiment of the bevel cutting unit of FIGS. 1 and 2, showing another alternative securing means.

FIG. 3D is a side view of a fourth alternative embodiment of the bevel cutting unit of FIGS. 1 and 2, showing yet another alternative securing means.

FIG. 5 is a perspective view of a vertical cutting unit and guide, showing the features thereof.

FIG. 6 is a perspective view of the cutting unit of FIG. 5, showing the blade in a retracted position.

FIG. 7 is a perspective view of an adaptor providing for the use of a bevel cutting unit as a vertical cutting unit.

FIG. 8 is a perspective view of the adaptor of FIG. 7 installed on a guide, with a bevel cutting unit installed thereupon.

Similar reference characters designate corresponding parts throughout the several figures of the drawings.

DESCRIPTION OF THE PREFERRED EMBODIMENT

Figure 1:
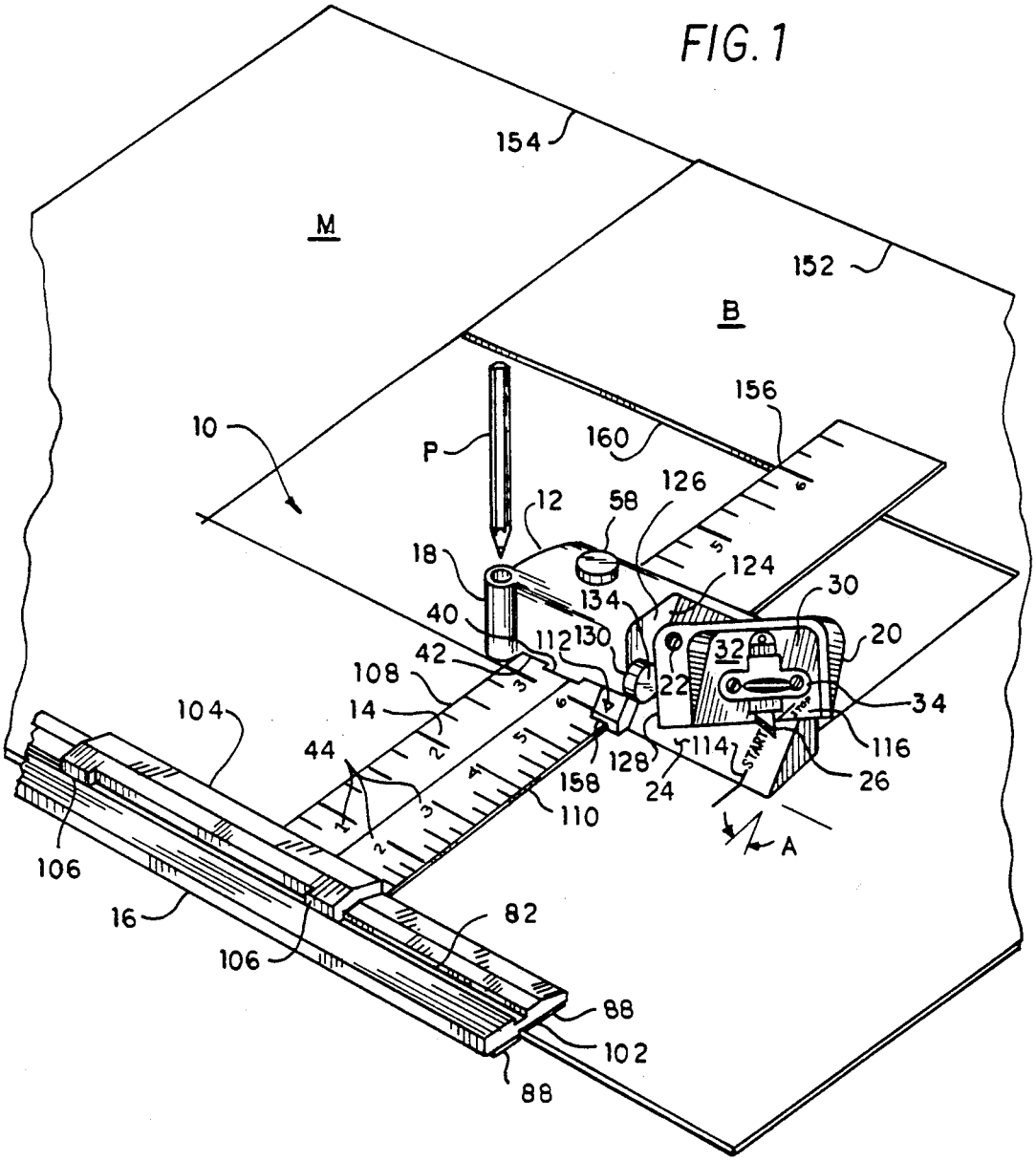
FIG. 1 is a perspective view of one embodiment of the present invention having a bevel cutting unit.

Referring now to the drawings, particularly FIG. 1 of the drawings, the present invention will be seen to relate to an improved mat cutting system 10 comprised of a cutting unit 12, conversion scale ruler 14, and straightedge guide 16. Cutting unit 12 possesses several integrated features which simplify the mat measuring and cutting process, such as having a holder 18 for a pencil P or other marking device formed as a unit with cutting unit 12. The function of holder 18, as well as the function of various other features of mat cutting system 10, will be explained further below.

Before proceeding further, it is important to note that there are two cutting angles which are commonly used in the art of mat cutting; Straight cuts, i.e. cuts in which the plane of the cutting blade is perpendicular to the mat surface during the cut and in which the resulting surface of the cut edge is perpendicular to the mat surface, and bevel cuts, in which the plane of the blade is at an angle other than 90 degrees to the mat surface during the cut. Bevel cuts are normally performed using a 45 degree angle between the plane of the cutting blade and the mat surface, but of course other angles may be used as the cutting equipment permits and as desired. The cutting unit 12 through 12D depicted in FIGS. 1 through 3D is formed for making bevel cuts, and units 12 through 12D accordingly contain features providing for a bevel cutting angle.

Cutting units 12 through 12D will be seen to have a pivoted cutting head 20, which is pivotally secured to cutting units 12 through 12D by pivot 22. Pivot 22 may be in the form of a screw or other shaft providing an axis about which cutting head 20 may pivot. Pivot 22 is installed at a 90 degree angle to ramp 24, thus permitting cutting head 20 and blade 26 to be applied to any mat material M by cutting straight into the material M, rather than applying a sideward thrust which would result in an uneven cut edge and possible damage to blade 26. As noted above, ramp 24 is normally formed to provide a 45 degree angle A to mat material M, but other angles may also be formed depending upon the construction of cutting unit 12.

Cutting head 20 is normally retained in a retracted state, i.e. with cutting blade 26 held above the underlying surface, by a spring 28, shown in FIG. 2. Positive pressure is required in order to force blade 26 downward and into mat material M for cutting. Upon the release of such pressure, spring 28 is of sufficient strength to cause blade 26 to withdraw from the closely fitting sides of the cut mat material M.

It will be appreciated that mat material M may be obtained in various thicknesses, and that in order to preclude excessive cutting depths, pressures and blade wear to blade 26, some means should be provided for the adjustment of the cutting depth of blade 26. Cutting unit 12 through 12D provides for this by means of a space 124 between surface 126 of cutting unit adjacent to ramp 24, and surface 128 of cutting head 20. The width of space 124 may be varied by means of adjustment screw 130, which is threaded into a cooperating hole 132 within cutting head 12. It will be seen from an examination of FIGS. 1 through 3D, that as adjustment screw 130 is disengaged from cooperating threaded hole 132, adjustment screw head 134 will move away from surface 126, thus causing space 124 to widen as surface 128 of cutting head 20 contacts screw head 134. As space 124 is varied, the maximum downward extension of cutting head 20 will vary and thus the depth of penetration of cutting blade 26. Accordingly, adjustment screw 130 may be adjusted as desired in order to provide for the optimum cutting depth of blade 26.

Blade 26 is retained within a receptacle 30 formed within the side of cutting head 20. The receptacle 30 provides a mounting surface 32 for blade 26 which is at essentially the same angle A as that of ramp 24, for the reasons noted above. Blade 26 may be retained within receptacle 30 by retainer 34, which may be secured by screws 36 and/or locking lever 38 as is more clearly shown in FIG. 2.

The remaining portion of cutting unit 12 provides for attachment to a conversion scale ruler 14. FIGS. 2 and 3A through 3D more clearly show the ruler retaining means which provide for the retention of scale 14. In each case, a closely cooperating slot 40 is formed in the bottom of cutting unit 12 in order to receive a conversion ruler 14. Further relief areas 42 are generally provided in order to provide clearance for any markings or indicia 44 which may be imprinted or otherwise formed on the surface of conversion ruler 14. Other than the variations in the retaining means for conversion ruler 14, the cutting units 12 through 12D of FIGS. 1 through 3D are essentially identical.

Figure 4B:
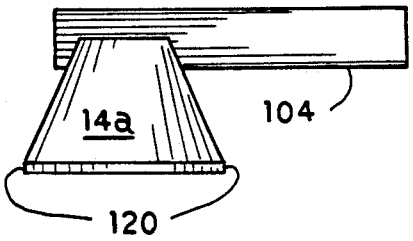
FIG. 4B is an alternative embodiment of the ruler of FIG. 4A, showing means for securing the ruler to the cutting units of FIGS. 3A, 3B or 3C.
Figure 4A:
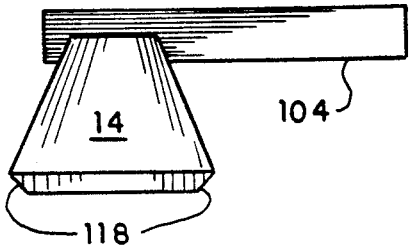
FIG. 4A is a perspective view of a conversion ruler showing a means for securing the ruler to the cutting unit of FIGS. 1 and 2.

In FIG. 2, these retaining means comprise extensions 46 which angle inward from the edges of slot 40, thus forming retaining lips which prevent the escape of conversion ruler 14 from directly beneath slot 40. In the case of the retaining extensions 46 of FIGS. 1 and 2, it will be seen that the edges of conversion ruler 14 of FIGS. 1 and 4A must provide overhanging extensions 118 in what is known as a "dovetail" pattern in order to properly cooperate with those angled retaining extensions 46. Similar extensions **46*a* capable of cooperating with a conversion ruler 14*a* of FIG. 4B having vertical edges 120 are shown to either side of slot 40 in FIG. 3A. The embodiment of FIG. 3B provides for the same retention function by means of retainer 48, which extends completely beneath slot 40 in order to retain conversion ruler 14*a* within slot 40. Retainer 48 may be secured to cutting unit 12B by a flange 50 and retaining screws 52, as shown in FIG. 3B. FIG. 3C discloses yet another retaining means for conversion ruler 14*a*, comprising a retaining extension 54 along one edge of slot 40 and an opposite clamp means 56 along the opposing edge of slot 40. Clamp means 56 may be secured with securing screw 58, which serves to draw clamp 56 toward the floor of slot 40, thereby securely clamping any conversion ruler 14*a* contained therein and preventing relative movement between cutting unit 12C and conversion ruler 14*a*. Essentially identical securing screws 58 will be noted to pass through the center of slot 40 in FIGS. 1, 2, 3A, 3B, and 3D, serving to urge any conversion ruler 14 or 14*a* contained therein against any retaining means 46, 46*a* or 48 as may be provided and thereby locking such conversion ruler 14** in place relative to the cutting unit.

Figure 4C:
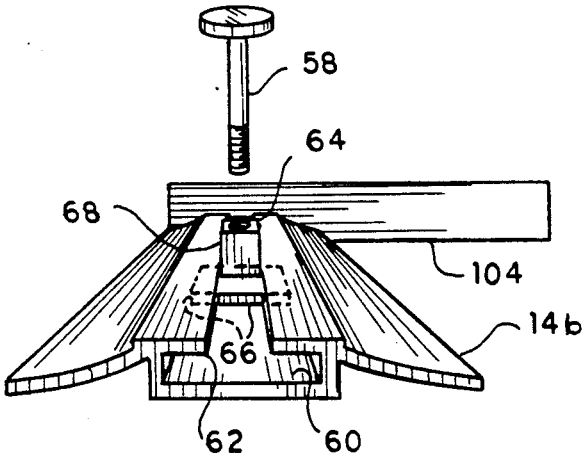
FIG. 4C is a second alternative embodiment of the ruler of FIG. 4A, showing means for securing the ruler to the cutting unit of FIG. 3D.
Figure 4D:
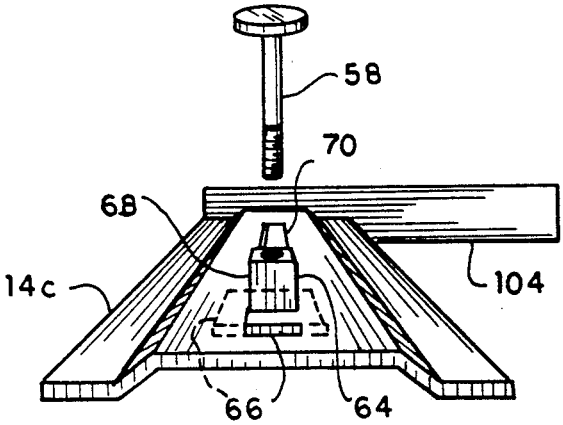
FIG. 4D is an alternative embodiment of the ruler of FIG. 4C.

Yet another method of retaining a conversion ruler may be used with the rulers **14*b* and 14*c* respectively shown in FIGS. 4C and 4D. Ruler 14*b* discloses a channel 60 which extends the length of ruler 14*b*. Ruler 14*b* also provides for two opposite extensions 62 at the upper edges of channel 60, which serve to retain a cooperating captured member 64 within channel 60. Captured member 64 will be seen to have a lower 66 and upper 68 flattened side, which flattened sides 66 and 68 serve to prevent the rotation of captured member 64 within channel 60 and thus allow a securing screw 58 to thread into and draw captured member upward and thereby clamp conversion ruler 14*b* within a closely cooperating slot 40*a* of a cutting unit 12D, as in FIG. 3D. The above precludes the need for various conversion ruler retaining means 46, 46*a*, 48, 54 and 56 as disclosed in FIGS. 3A, 3B and 3C. Similarly, the conversion ruler 14*c* of FIG. 4D provides a longitudinal slot 70 in the center of ruler 14*c*. A captured member 64 may be prevented from rotating within slot 70 by means of flattened upper sides 68, as in the case of the embodiment disclosed in FIG. 4C. The remaining operation of securing conversion ruler 14*c* within a cutting unit 12D is identical to that described for the ruler 14B of FIG. 4C**.

The above described cutting units 12 through 12D and conversion rulers 14 through **14*c* are normally used together in the bevel cutting of openings in mat material. However, it is also necessary to cut or trim the outer borders of the mat material M. FIGS. 5 and 6 disclose the straight cutter 72 which may be used for such cutting of outer edges of mat material M. It will be noted that many of the features of straight cutter 72 are identical to those of bevel cutting units 12 through 12D, such as pivot 22, blade 26, blade retainer 34, retainer screws 36, and locking lever 38. The primary difference between bevel cutting unit 12 and straight cutter 72 lies in the orientation of the various components, which in turn is dictated by the angle of the cut provided by cutters 12 and 72. In each case, it will be noted that the longitudinal axis of pivot 22, and therefore the pivotal motion of both cutting head 20 of bevel cutter 12 and straight cut head 74 of straight cutter 72, is perpendicular to the plane of cutting blade 26. This assures that the angular motion of cutting blade 26 is in the same plane as that of blade 26 when either cutting head 20 or straight cut head 74 is rotated. To accomplish the desired biasing of straight cut head 74 in the normally retracted position, a compression spring 28*a* is used rather than the torsional spring 28 shown for that purpose in the bevel cutter unit of FIG. 2. It will be apparent that either method could be adapted to either the bevel cutting unit 12 or straight cutter 72**.

The other primary differences between the bevel cutting units of FIGS. 1 through 3D and the straight cutter 72 of FIGS. 5 and 6, are that there is no means for attachment to a conversion ruler 14 through **14*c* nor marker holder means in the straight cutters 72 of FIGS. 5 and 6. While those features are not needed in straight cutter 72, it is essential to provide for a straight cut along a desired line. To accomplish this, an extension 76 is provided from the base 78 of straight cutter 72. Extension 76 includes a depending tongue 80, which tongue 80 cooperates with a slot 82 in the top of guide 16 as shown in FIG. 5. Guide 16 will be seen to provide an extended edge 84 at one end, which extended edge is normal to the edges of guide 16 and in a plane slightly below the plane of the base of guide 16, and thereby provides for the function of the well known "T square." Extended edge 84 may be secured to guide 16 by means of rivets 122, screws, or any other suitable means. However, it will be noted that a recess 86 in one side of extended edge 84 provides additional clearance in the operation of straight cutter 72**, the reason for which will be discussed further below.

An alternative to the use of straight cutter 72, when vertical cuts are required, is a means of adapting a bevel cutter 12 through **12*d* to perform straight or vertical cuts. The adaptor 136 shown in FIGS. 7 and 8 serves to accomplish this. Adaptor 136 is formed with two arms 138 and tongue 140, serving the same function as extension 76 and tongue 80 of straight cutter 72. Arms 138 provide a central opening 142 therebetween, providing for the installation of a bevel cutter 12 upon adaptor 136. Adaptor arms 138 and tongue 140 cooperate with guide 16 and guide slot 82 in the manner of the corresponding components of cutter 72**.

A base 144 extends from extension 138 and is formed to provide an underlying surface 146 which will be parallel to and ride over the underlying mat M as adaptor 136 is used with a bevel cutter 12. An adaptor ramp 148 extends upward at an angle from base 144, which ramp 148 contains a track 150 formed to cooperate with the appropriate attachment means of a bevel cutter 12. (The dovetail arrangement shown in FIGS. 1 and 2 for the attachment of bevel cutter 12 to ruler 14 is shown as an example in FIGS. 7 and 8. It will be apparent that any of the several cooperating attachment means described above may be adapted to seen to form a complementary angle O to the angle A formed by cutting unit ramp 24; the principle of operation remains the same, no matter what the two individual angles A and O may be, so long as angles A and O total 90 degrees in order to provide for a vertical blade 26 relative to mat material M.

The preparation of any mat material or similar material M will generally begin with a determination of the outer borders desired. Appropriate dimensions may be measured and marked on material M in the conventional manner, and material M and guide 16 placed over any suitable surface or scrap material, not shown, with the edge adjacent to straight cutter 72 aligned with the appropriate mark along which the cut is desired and with extended edge 84 abutting the edge of material M. Guide 16 resists any undesired movement due to base layers 88 of rubberized or other suitable material having a relatively high coefficient of friction, as shown in FIG. 1, which are in direct contact with the underlying material M.

Straight cutter 72 may then be installed on guide 16 by inserting tongue 80 into guide slot 82, with straight cutter 72 positioned to the edge of guide 16 which has been aligned with the cutting mark. Straight cutter 72 may be positioned with the trailing end 100 actually overlapping the edge of material M and extended edge 84, as the recess 86 in extended edge 84 provides clearance for blade 26 as blade 26 is lowered to begin the cut at the edge of material M. Alternatively, adaptor 136 may be installed upon guide 16 in a similar manner, and bevel cutter 12 installed upon adaptor 136.

At this point, spring 28*a* (or 28, in the case of bevel cutter 12) will cause cutting head 74 (or 20) to be retracted from the material M to be cut. In order to prevent blade 26 from making too deep a cut, depth adjustment screw 90 (or 130, in the case of bevel cutter 12) may be adjusted. The lower end 92 of adjustment screw 90 bears against the surface 94 of straight cutter base 78. As blade 26 is positioned within the recess 86 of extended edge 84 at this point, depth adjustment screw 90 may be easily adjusted in order to allow the tip of blade 26 to barely contact any underlying surface and thereby provide for a complete cut through the overlying material M without undue effort due to the possible cutting of the underlying material or additional wear and tear on blade 26. The leading edge 96 of straight cutter head 74 includes a stop 98 which bears against a portion of straight cutter base 78 in order to prevent cutter head 74 from pivotally lifting or opening to too great a degree. The operability of depth adjustment screw 130 in bevel cutter 12 has been discussed above.

In order to complete the desired cut of material M, palm pressure is used to lower cutting head 74 until the lower end 92 of depth stop 90 contacts the surface 94 of straight cutter base 78. It will be noted at this point that the plane of cutting blade 26 is immediately adjacent the nearest edge of guide 16, thus permitting that edge of guide 16 to be aligned with the cutting mark with assurance that blade 26 will accurately follow the cutting mark. Further pressure is used away from the operator to cause straight cutter 72 to follow guide 16 by means of extension 76 and tongue 80 cooperating with slot 82, thus providing an accurate cut along the desired line. The process is repeated as desired until the final size and shape of material M is achieved. Another point which should be noted is that both the leading end 96 and the trailing end 100 of straight cutter 72 are rounded, in order that either end 96 or 100 may comfortably fit the hand and palm of the operator. In this way, the direction of operation of straight cutter 72 may be reversed as desired for drawing toward the operator by merely reversing the orientation of cutting blade 26. Such reversible operation also provides for ease of use by persons who are left handed.

Once the outer dimensions of material M have been established as outlined above, the inner opening may be measured, marked and cut by means of bevel cutting unit 12, conversion scale ruler 14 and guide 16. First, the desired opening in the material M must be determined. This is accomplished simply by aligning a first edge 152 of the generally rectangular piece of flat artwork B to be framed with the corresponding edge 154 of the border or mat material M, as shown in FIG. 1. Underlying stop edge 102 of guide 16 is then abutted with the opposite edge of material M, as shown in FIG. 1. Conversion ruler 14 with its accompanying slide 104, which provides a right angle between ruler 14 and guide 16, is then installed on guide 16 by means of extensions 106 which cooperate with slot 82 of guide 16. The remaining material M between the stop edge 102 of guide 16 and second edge 160 of artwork B is then measured with the larger scale 108 of the two scales 108 and 110 provided on conversion ruler 14. It will be noted in FIG. 1 of the drawings that the indicated measurement 156 on scale 108 corresponds to measurement 158 on scale 110.

Conversion ruler 14 provides for a simplification not known in the prior art, in that ruler 14 is attached directly to guide 16 and the two scales 108 and 110 of conversion ruler 14 are marked so as to have their starting points coincident with the underlying stop edge 102 of guide 16, and therefore with the abutting edge of material M. As it is generally desirable to center the artwork B within the finished material M, it will be apparent that the distance from the edge of material M and stop edge 102 to the second edge 160 of artwork B, will be twice that of the desired edge distance provided by material M when artwork B is centered therein.

Conversion ruler 14 provides for two different scales 108 and 110 in the ratio of two to one in order to simplify this measurement process. The larger scale 108 is used to measure the remaining material M extending from the edge of material M to the second edge 160 of artwork B, whereupon bevel cutting unit 12 may be aligned with the half scale 110 by means of indicator 112 and locked in place with securing screw 58. This procedure automatically places cutting unit 12, and therefore marker P in holder 18 of cutter 12, at the proper point along conversion ruler 14 to establish the proper mark and/or cut in material M. In fact, it will be evident at this point that the step of marking material M could be eliminated except for the necessity of noting the points where the cuts are to begin and end, i.e. the corners of the desired opening. In any event, conversion ruler 14 and slide 104, with cutting unit containing marker P locked in place, are then advanced along guide 16 in order to establish the appropriate mark to be used for establishing a bevel cut in material M. this measurement process is then duplicated by turning material M so that the opposite edge is abutting guide stop 102 and the opposite cut line marked, without the need for resetting the position of cutting unit 12 relative to conversion scale 14 or any other calculations. The remaining two lines are determined by turning material M and artwork B 90 degrees and repeating the process described above.

In the above measurement and marking process, cutting head 20 is raised due to the action of spring 28 in order to preclude any cutting of material M by blade 26. In order to accomplish the desired bevel cuts, cutting unit 12 is aligned with the appropriate marking on material M as accomplished in the steps described above. A "start" indicator 114 is positioned on the face of cutting unit ramp 24, which precisely coincides with the tip of blade 26 when cutting head 20 is lowered to make the cut. The exact depth of the cut to be made by blade 26 may be adjusted by means of adjustment screw 130, as described further above. By applying pressure with the hand and palm downward and forward, cutting head 20 is lowered to cause blade 26 to penetrate material M, and cutting unit 12, conversion ruler 14 and slide 104 are advanced along guide 16 until blade 26 reaches the next appropriate marking on material M. In the event that blade 26 may not be readily visible, and additional "stop" indicator 116 may be provided on cutting head 20, which indicator 116 may be aligned with the appropriate marking on material M in order to indicate the end of the cut. Upon reaching the end of the cut, pressure is released on cutting head 20, and the action of spring 28 causes head 20 to raise and automatically withdraw blade 26 from the completed cut in material M.

It will be appreciated that the above action may be reversed so that cutting unit 12, conversion ruler 14 and slide 104 may be drawn toward the operator by merely reversing the orientation of blade 26, as described in the operation of cutting the exterior dimensions of material M above. This reversal capability further facilitates the use of mat marking and cutting system 10 by left handed persons, as noted above. Alternatively, the user of the apparatus described herein may merely reverse the position of the various components relative to himself, and use the entire apparatus in a reversed or "upside down" fashion, if desired. It will be further apparent that the relative positions of the various components comprising each of the cutting units 12 and 7 may be arranged in a manner opposite to that shown in the accompanying drawings, if desired. Such adaptability provides further utility for left handed persons, and/or those who may wish to draw the appropriate cutting head 12 or 72 toward them, rather than pushing it away from them, during the operation of the device.

It is to be understood that the present invention is not limited to the sole embodiment described above, but encompasses any and all embodiments within the scope of the following claims.

I claim:

1. An artwork mat marking and cutting apparatus for the marking and cutting of artwork mat and other sheet material, said apparatus including:

a guide having a longitudinal dimension and a proximal end;

an extension located at said guide proximal end, and being normal to said guide longitudinal dimension;

said extension including a conversion scale ruler having a first scale and a second scale with said first scale comprising markings having a ratio of two to one relative to said second scale;

said conversion scale ruler having means providing for normal and slidable attachment to said guide;

a mat cutting unit including a pivotable cutting head having a cutting blade;

said cutting unit further including conversion scale ruler retention means, mat marking means, blade retention means, means urging said cutting head away from said sheet material and means for securing said cutting unit to said conversion scale ruler;

said pivotable cutting head having a pivot axis disposed at an angle other than parallel to said sheet material;

said cutting blade having a plane perpendicular to said pivot axis, whereby said cutting unit is secured to said conversion scale ruler, said conversion scale ruler is slidably attached to said guide, and said mat marking means is sued to mark said sheet material as said conversion scale ruler and said cutting unit are slidably moved along said guide.

2. The apparatus of claim 1, including:

cut start and stop indicators on said cutting unit and a conversion scale ruler indicator.

3. The apparatus of claim 1, including:

cutting depth adjustment means for said cutting blade.

4. The apparatus of claim 1, wherein said conversion scale ruler retention means comprise a slot within said cutting unit; and said slot having opposing sides providing extensions capturing said conversion scale ruler within said slot.

5. The apparatus of claim 4, wherein one said extension comprises an adjustable clamp providing for the capture of said conversion scale ruler within said slot.

6. The apparatus of claim 1, wherein said conversion scale ruler retention means comprises a slot within said cutting unit; and said slot having a retainer extending thereacross and capturing said conversion scale ruler within said slot.

7. The apparatus of claim 1, wherein said conversion scale ruler retention means comprise a channel within said conversion scale ruler; and said ruler channel having a captured member therein with said channel captured member cooperating with means securing said captured member and said conversion scale ruler to said cutting unit.

8. The apparatus of claim 1, wherein said conversion scale ruler retention means comprise a slot within said conversion scale ruler; and said ruler slot having a captured member therein with said captured member cooperating with means securing said captured member and said conversion scale ruler to said cutting unit.

9. The apparatus of claim 1, wherein said pivotable cutting head axis is 45 degrees to said sheet material.

10. An artwork mat marking and cutting apparatus for the marking and cutting of artwork mat and other sheet material, said apparatus including:

a guide having a longitudinal dimension and a proximal end;

an extension located at said guide proximal end, and being normal to said guide longitudinal dimension;

said extension including a conversion scale ruler having a first scale and a second scale with said first scale comprising markings having a ratio of two to one relative to said second scale;

said conversion scale ruler having means providing for normal and slidable attachment to said guide;

a mat cutting unit including a pivotable cutting head having a cutting blade;

said cutting unit further including conversion scale ruler retention means, mat marking means, blade retention means, means urging said cutting head away from said sheet material and means for securing said cutting unit to said conversion scale rule;

said pivotable cutting head having a pivot axis disposed at an angle other than parallel to said sheet material;

said cutting blade having a plane perpendicular to said pivot axis, whereby said cutting unit is secured to said conversion scale ruler, said conversion scale ruler is slidably attached to said guide, and said cutting blade is pivotally urged into cutting contact with said sheet material as said conversion scale ruler and said cutting unit are slidably moved along said guide.

11. The apparatus of claim 10 including:

a conversion scale ruler indicator and cut start and stop indicators on said cutting unit.

12. The apparatus of claim 10 including:

cutting depth adjustment means for said cutting blade.

13. The apparatus of claim 10, wherein said conversion scale ruler retention means comprise a slot within said cutting unit; and said slot having opposing sides providing extensions capturing said conversion scale ruler within said slot.

14. The apparatus of claim 13, wherein one said extension comprises an adjustable clamp providing for the capture of said conversion scale ruler within said slot.

15. The apparatus of claim 10, wherein said conversion scale ruler retention means comprise a slot within said cutting unit; and said slot having a retainer extending thereacross and capturing said conversion scale ruler within said slot.

16. The apparatus of claim 10, wherein said conversion scale ruler retention means comprises a channel within said conversion scale ruler; and said ruler channel having a captured member therein with said channel captured member cooperating with means securing said captured member and said conversion scale ruler to said cutting unit.

17. The apparatus of claim 10, wherein said conversion scale ruler retention means comprise a slot within said conversion scale ruler; and said ruler slot having a captured member therein with said captured member cooperating with means securing said captured member and said conversion scale ruler to said cutting unit.

18. The apparatus of claim 10, wherein said pivotable cutting head axis is 45 degrees to said sheet material.

* * * * *